US007861335B2

(12) United States Patent
DeLuca et al.

(10) Patent No.: US 7,861,335 B2
(45) Date of Patent: Jan. 4, 2011

(54) AIR BEARING PALLET

(75) Inventors: Richard Thomas DeLuca, Kalamazoo, MI (US); Kevin Mark Patmore, Plainwell, MI (US)

(73) Assignee: Stryker Corporation, Kalamazoo, MI (US)

( * ) Notice: Subject to any disclaimer, the term of this patent is extended or adjusted under 35 U.S.C. 154(b) by 767 days.

(21) Appl. No.: 11/801,007

(22) Filed: May 8, 2007

(65) Prior Publication Data

US 2007/0266494 A1 Nov. 22, 2007

Related U.S. Application Data

(60) Provisional application No. 60/809,583, filed on May 30, 2006, provisional application No. 60/746,765, filed on May 8, 2006.

(51) Int. Cl.
*A61G 7/10* (2006.01)
*A47C 27/08* (2006.01)

(52) U.S. Cl. ..... 5/81.1 R; 5/81.1 HS; 5/712

(58) Field of Classification Search ..... 5/81.1 R, 5/81.1 HS, 706, 710–713, 644, 654, 655.3
See application file for complete search history.

(56) References Cited

U.S. PATENT DOCUMENTS 585,834 A * 7/1897 Ruth ..... 5/711
3,705,429 A * 12/1972 Nail ..... 5/710
4,483,030 A 11/1984 Flick et al.
5,065,464 A 11/1991 Blanchard et al.
5,067,189 A 11/1991 Weedling et al.
5,483,709 A 1/1996 Foster et al.
RE35,299 E 7/1996 Weedling et al.
5,561,873 A 10/1996 Weedling
6,073,291 A 6/2000 Davis
6,467,106 B1 10/2002 Heimbrock
6,618,884 B1 9/2003 Wu
6,701,544 B2 3/2004 Heimbrock
6,820,292 B2 11/2004 Heimbrock
6,898,809 B2 5/2005 Davis
7,028,350 B1 4/2006 Davis
7,032,261 B2 4/2006 Heimbrock
7,107,641 B2 9/2006 Davis
7,168,115 B2 1/2007 Davis
7,266,852 B2 9/2007 Davis
7,373,680 B2 5/2008 Davis
7,376,995 B2 5/2008 Davis
7,406,723 B2 8/2008 Davis
7,565,709 B2 7/2009 Davis
7,574,761 B2 8/2009 Davis
7,627,910 B2 * 12/2009 Davis ..... 5/81.1 R
7,712,170 B2 * 5/2010 Davis ..... 5/711
7,725,963 B2 * 6/2010 Johnson ..... 5/81.1 R
7,735,164 B1 * 6/2010 Patrick ..... 5/81.1 HS (Continued)

*Primary Examiner*—Robert G Santos
(74) *Attorney, Agent, or Firm*—Van Dyke, Gardner, Linn & Burkhart, LLP

(57) ABSTRACT

The present invention provides an air bearing pallet comprising a network of tethers oriented and connected between the upper and bottom sheets of a plenum chamber, which cause a system of indentations to become formed in the bottom sheet when the plenum chamber is inflated. Perforations in the bottom sheet enable air to escape thereby generating an air film below the chamber within the predefined system of indentations. The size, shape, depth, bottom surface tension/stiffness, airflow through, quantity and location of the indentations can be varied in order to optimize lifting performance and efficiency and reduce system level losses over irregularities and gaps in the support surface.

19 Claims, 14 Drawing Sheets

U.S. PATENT DOCUMENTS

2002/0162172 A1 11/2002 Federowicz
2002/0166168 A1 11/2002 Weedling et al.
2003/0159212 A1* 8/2003 Patrick et al. ..... 5/81.1 R
2005/0028273 A1 2/2005 Weedling et al.
2005/0034229 A1 2/2005 Weedling et al.
2005/0034230 A1 2/2005 Weedling et al.
2005/0034242 A1* 2/2005 Davis ..... 5/711
2005/0076437 A1* 4/2005 Johnson ..... 5/81.1 R
2005/0091751 A1* 5/2005 Davis ..... 5/711
2005/0132490 A1* 6/2005 Davis ..... 5/81.1 R
2006/0021133 A1* 2/2006 Davis ..... 5/81.1 R
2006/0123550 A1* 6/2006 Davis ..... 5/655.3
2006/0162086 A1 7/2006 Davis
2006/0213010 A1 9/2006 Davis
2007/0000048 A1 1/2007 Davis
2007/0006385 A1* 1/2007 Davis ..... 5/710
2007/0266494 A1* 11/2007 DeLuca et al. ..... 5/81.1 R
2008/0011989 A1* 1/2008 Davis ..... 254/93 HP
2008/0104762 A1 5/2008 Davis
2008/0189866 A1* 8/2008 Davis ..... 5/711
2008/0289102 A1 11/2008 Davis
2010/0024123 A1* 2/2010 Davis ..... 5/81.1 R

* cited by examiner

AIR BEARING PALLET

CROSS-REFERENCE TO RELATED APPLICATIONS

This application claims priority from U.S. provisional application Ser. No. 60/746,765, filed May 8, 2006, entitled AIR BEARING PALLET, by Applicant Kevin Patmore, and U.S. provisional application Ser. No. 60/809,583, filed May 30, 2006, entitled AIR BEARING PALLET, by Applicant Kevin Patmore, which are incorporated by reference herein in their entireties.

FIELD OF THE INVENTION

The present invention pertains to the field of load bearing and moving devices and in particular to an air bearing pallet apparatus for movement and transfer of a patient.

BACKGROUND

Non-ambulatory patients who must be supported and moved in a patient facility such as a hospital or a nursing home present substantial challenges when a course of treatment for such patients calls for movement from one location to another. A patient may, for example, need to be moved from a hospital bed, which must remain in the patient's room, to a stretcher and then from the stretcher to a treatment location such as a surgical table in an operating room. Following treatment the reverse patient handling sequence must occur; i.e.: the patient must be moved from the surgical table, which remains in the operating room, to a stretcher which travels to the patient's hospital room, and then from the stretcher back onto the bed in the hospital room.

In a very large percentage of such occurrences the patient must be handled in a fashion which requires only a minimum of movement of the patient with respect to his or her supporting surface. In the case of a patient being returned to a hospital room following surgery, for example, the patient's body may not be able to withstand the stresses and strains of being lifted from a stretcher to the bed when one or even several hospital personnel combine their efforts to make such a transfer.

The same challenge of moving a patient with minimum handling exists in non-surgical settings as well. The bariatric patient is a prime and very common example. When such a patient is categorized as morbidly obese, transfers present difficulties for both the patient and the care facility staff. While no exact definition of morbid obesity is universally recognized, many hospitals and other treatment facilities consider a person who weighs about 350 pounds or more to fall within that definition.

Movement of a morbidly obese person often requires the hospital staff to physically lift and/or slide the patient from an at rest position on a hospital bed to an at rest position on a stretcher a total of four times to complete a single treatment cycle, such as surgery. The staff must perform the task of lifting and/or sliding such a patient because in nearly all instances the patient, due to the physical condition of obesity and/or illness, simply cannot do the task alone. The manipulation of such a person requires a plurality of hospital staff since such manipulation is impossible to perform by a single person such as a floor nurse assigned to the patient's room. As a consequence such transfers must be planned in advance for a specific time and a number of hospital staff must be notified and arrange their schedules so that all staff will be available at the exact same time whereby the task, which may take only a few minutes once the manpower is available, can be carried out in a timely fashion. In some instances, half dozen or more such persons may need to be assembled for this movement. Instances have been known in which a morbidly obese patient has required twelve persons to enable the transfer of such a patient. Gathering together such a large number of people four times at often uncertain intervals to provide but a single cycle of treatment to a patient raises obvious logistical problems and, in addition, erodes the quality of care the facility can render by reason of the application of such a large number of personnel to deal with but a single patient treatment episode.

While morbidly obese patients represent an extreme end of the spectrum, it should be understood that making any transfer, lateral or otherwise, of any patient or adjustment to a patient's position can induce stress and/or strain and potential injury to a caregiver.

A further drawback to such a patient handling system as above described is that, even with the best intentioned and caring of staff, the patient very often suffers substantial discomfort. The simple act of sliding a patient over a flat surface can be very painful to a patient who has had surgical incisions which are far from healed, for example.

An attempt has been made to overcome the above described problems by the use of an air mattress onto which the patient is placed while in bed and which is then placed onto a stretcher. A problem common to all such devices however is that invariably the air mattress has the general characteristic of a balloon in the sense that when one area is indented another remote area will bulge, thus creating an unstable condition. If for example a stretcher carrying an obese person makes a sharp turn during a trip to or from a treatment location, such an obese person will tend to roll toward the outside of the turn due to the instability of such a conventional air mattress. The more the patient rolls, the more that that portion of the edge of the mattress toward which the rolling movement occurs will depress, and the greater will be the expansion of the mattress on the other side of the patient. In effect, the conventional mattress reinforces the undesirable rolling movement and hence can be termed to be unstable. Since much of the time the patient is incapable of stopping the rolling action alone the patient may roll off the stretcher onto the floor with disastrous consequences. Indeed, even in the instance of a patient who is capable of moving themselves to some degree about their longitudinal body axis the same disastrous result may occur because the displacement of air from one edge portion of the mattress to the opposite edge portion creates in effect a tipping cradle. Only if the patient lies perfectly flat and perfectly still on the stretcher and no roadway depressions or blocking objects, such as excess hospital beds stored in a hallway, are encountered can the probabilities of an accident be lessened.

Planar air pallets and air-bearing patient movers of the type disclosed in U.S. Pat. No. 3,948,344 entitled "LOW COST PLANAR AIR PALLET MATERIAL HANDLING SYSTEM" and U.S. Pat. No. 4,272,856 entitled "DISPOSABLE AIR-BEARING PATIENT MOVER AND VALVE EMPLOYED THEREIN" employ at least one thin, flexible bottom sheet for partially defining a plenum chamber, which is perforated by way of small, closely spaced pinholes over a surface area defined by the imprint of the load, which pinholes face an underlying fixed, generally planar support surface. The pinholes open unrestrictedly to the interior of the plenum chamber and to the planar support surface. When the plenum chamber is pressurized by low pressure air, the air initially jacks the load upwardly above the thin, flexible sheet, then air escapes under pressure through the minute pinholes and creates a frictionless air bearing of relatively small height between the underlying support surface and the bottom of the perforated flexible sheet.

In all air pallets, including patient movers, it is necessary to provide controlled pillowing of the thin, flexible sheet material, particularly outside the perforated surface area of that sheet to initially jack the load above the flexible sheet prior to the creation of the frictionless air bearing and to insure the ability of the air pallet to ride over surface projections on the underlying support surface. Means must also be provided within the air pallet to prevent ballooning of the thin, flexible sheet or flexible sheets defining the plenum chamber whereby the plenum chamber takes a circular or near circular vertical cross-section, the result of which could be the tilting or rolling of the load off the top of the air pallet. Further, when the load rests on the air pallet, prior to the pressurization of the plenum chamber the load tends to press the perforated flexible sheet into contact with the underlying support surface which prevents the entry of air under light pressure into the plenum chamber.

In the development of the air pallets, and in particular air bearing patient movers as a form of such air pallets as exemplified by U.S. Pat. No. 3,948,344, a corrugated sheet such as sheet within the single chamber functioning as a plenum chamber in a patient mover formed by two superimposed thin, flexible sheets in U.S. Pat. No. 4,272,856 may constitute both a unitary air dispersion means and a semi-rigid backing member (if needed). The semi-rigid backing member may comprise a semi-rigid sheet inserted within a cavity formed between the top thin, flexible sheet and an intermediate thin, flexible sheet. Alternatively, the backing member may be formed of a series of transversely linked air pressurized tubes formed by sealing off parallel, laterally adjacent longitudinal sections of the top sheet and the intermediate sheet. Such tubes may be completely sealed and air pressurized through valves. In a flow-through system, the pressurized air forming the air bearing passes first through parallel, transversely linked tubes defined by the top and intermediate sheets and then into the plenum chamber defined by the intermediate sheet and the bottom sheet with the bottom sheet bearing the pattern of perforations over the foot print of the load. U.S. Pat. No. 4,528,704 entitled "SEMI-RIGID AIR PALLET TYPE PATIENT MOVER" is directed to such air pallets.

In the field of air pallets and particularly of the patient mover type those patient movers formed of multiple, thermal bonded or stitched sheets of thin, flexible sheet material which incorporate a rigid or a semi-rigid sheet as the load backing member are not universally employed in health care treatment facilities. The existence of the rigid or semi-rigid sheet carried within a pocket or cavity defined by two thin, flexible sheets renders the assembly bulky, and adds considerably to the weight of the same. While such patient mover may perform extremely well at a certain hospital station or treatment area such as facilitating patient movement onto and from an X-ray table, the patient mover remains at the area and is unlikely to be employed in moving the patient to and from the hospital bed remote from the X-ray area since hospital personnel resist transporting such patient mover from location to location.

There are significant differences between the rigid back air pallet and the flexible or air chamber-type air pallet with a load that can flex. In the development of air pallets and air pallet-type patient movers utilizing a thin, flexible bottom sheet partially defining a plenum chamber and being perforated by way of thousands of small, closely spaced pinholes over the surface area defined by the imprint of the load and which open unrestrictedly to the interior or the plenum chamber and to an underlying planar support surface, such air pallets and air pallet-type patient movers have generally employed a rigid backing member starting with U.S. Pat. No. 3,948,344.

Certain structural features and parameters with respect thereto play a very important part in the successful operation of an air pallet having a rigid backing member. The key for successful movement of a load on a developed air film by air escape from the perforations is to make the air work on the load and to control the action of the air in doing that job. By matching the footprint of the load to that of the plenum chamber pattern area of perforations, thus generally matching the area of the developed air film to that of the load, the air pallet with the plenum chamber pressurized will jack the load, create the air bearing and permit the load to be stably moved on the air pallet.

Successful operation of rigid backing surface type air pallets requires controlled jacking, controlled pillowing and anti-ballooning. Control of load distribution may be achieved by the use of a rigid backing member such as a board or sheet as part of the plenum chamber, or within a separate chamber supporting the load but overlying the plenum chamber. The rigid backing member distributes the load mass balanced equally over the area of the plenum chamber footprint. The control of the plenum chamber can be performed in several ways and a properly designed plenum chamber can affect several of the control functions, i.e., jacking, pillowing and ballooning.

In U.S. Pat. No. 4,272,856 for an operative air pallet-type patient mover, pillowing is controlled by having the pattern of perforations extending to the edge of the plenum chamber and the sides of the plenum chamber are purposely designed to match the head and torso of the patient from the shoulders to the hip, where the load mass of the patient is concentrated. Certain parameters with respect to the load, i.e., weight, patient size and load footprint, are matched to the plenum chamber area, otherwise the unit will not work or work poorly.

An air pallet plenum chamber upon pressurization tends to take a shape resulting in lateral reduction of the plenum chamber air film footprint. Since the patient's body is movable and flexes, this creates significant problems. Not only is such load not rigid, but the top flexible sheet is not a rigid member and, indeed nothing structurally is rigid. Further, only the torso and head is supported by the plenum chamber (i.e., jacked up), and the rest of the body (legs, arms, etc.) simply drag along with the air pallet once an air bearing or air film is created by escape of air through the perforations within the thin, flexible bottom sheet. If the patient has a broken limb, this is not a small problem but a catastrophe. Patient loading on the air pallet and removal from the air pallet produces significant problems. Thus, the ability to create a patient mover having a size to fit the patient, the bed, the portable gurney and a procedure table such as an operating table was quite desirable.

These problems led initially to developments exemplified by U.S. Pat. Nos. 4,528,704 and 4,686,719. The key to solving most of the problem areas seemed to lie in the utilization of a rigid backing member, but a rigid backing member made it more difficult to place the patient on the patient mover. The patient has to be physically log-rolled, and almost face down to one side so that the rigid backing member is juxtapositioned to the patient, and the patient is then rolled back over so that the patient ends up supine on the patient mover. This procedure follows that of placing the sheet under a patient when on a hospital bed, but a sheet can be folded in half and slid under the patient without turning their body excessively to one side. Such is not so for a patient mover having a rigid backing member.

Other attempts have included using a flexible pad in place of the rigid backing member. Generally at the same time, there was considered the separation of the jacking action from that of creation of the frictionless air film. This led to the development of stacked tubes, one functioning as a pure jacking chamber, and the second as a combined jacking chamber and plenum chamber. The result is a gas pressurized jacking structure with improved load stability, in which the same compressed air pressurizing the upper chamber through a dynamic flowthrough arrangement, functions in passing through the pin hole perforations of the plenum chamber thin, flexible bottom sheet, to create the air film.

In air chamber-type air patient movers, a phenomenon was experienced as the result of air pressurization of the tubular chambers formed by sealed sections of the upper two thin, flexible sheets and the air pressurization of the plenum chamber underlying all of the upper row of tubes common to the intermediate thin, flexible sheet of said row of tubes. The entire unit took on a full vertical circular cross-section and attempted to approach a cylinder, which was termed "hot dogging". During hot dogging, the plenum chamber takes on an almost circular cross-section in a plane at right angles to the longitudinal axis of the series of joined tubes formed by the top thin, flexible sheet, the intermediate thin, flexible sheet and the bottom thin, flexible sheet of the air pallet. A plenum chamber is formed between the thin, flexible intermediate sheet and bottom sheet with the bottom sheet having literally thousands of closely spaced pinholes through which air escapes from the plenum chamber to form an air film or air bearing between the thin, flexible bottom sheet and the generally rigid, planar surface beneath. Each of the transverse seal lines joining the top and intermediate sheets, which together form individual air pressurizable chambers or tubes, function as hinging areas between adjacent tubes. The result of such hinging is the high instability for any load in contact with the exterior of the top thin, flexible sheet. It is further seem that the single large sectional area formed by the plenum chamber is without a means for controlling hot dogging and is thus extremely susceptible to this instability problem.

In U.S. Pat. No. 5,067,189 entitled AIR CHAMBER TYPE PATIENT MOVER AIR PALLET WITH MULTIPLE CONTROL FEATURES, the foregoing described problems of over pressurization causing instability of the patient mover and the load, enlargement of the underlying plenum chamber to an almost vertical circular cross-section, i.e. "hot dogging", during pressurization, the requirement for a rigid or semi-rigid backing member to prevent "hinging" between individual longitudinal chambers or tubes for supporting the load, and the point load grounding out on the underlying support surface due to load shifting were tentatively resolved. During the course of improving the earlier air pallet patient movers of the air chamber type, it was found that all of the recited problems with prior types of inflatable air pallets were substantially interrelated, as well as the discovery of an additional structural problem described as the reduction or shrinkage of the lateral dimension of the air pallet. U.S. Pat. No. 5,067,189 reduces the recited problems through a novel interrelated structure. In lieu of a rigid or semi-rigid backing member, a series of stacked rows of pressurized chambers or tubes have been utilized which create a pre-determined air dispersion which, in concert with the air dispersion in the underlying plenum chamber, properly jacks the load, e.g. a patient, and maintains the flexible backing surface (the stacked rows of tubes or chambers) in a planar direction generally parallel to the underlying developed air film. Simultaneously, the plenum chamber is inflated and through the underlying perforations creates an air film between the air pallet and the fixed support surface, but only in an area which generally matches the footprint of the load. Further, the inflation of the plenum chamber within the parameters set forth in U.S. Pat. No. 5,067,189 creates a sufficient pillowing means to permit the air pallet to accommodate surface irregularities and move the load on the developed air film without bottoming out, for example grounding, and without the bottom flexible sheet ballooning outward. This is accomplished through a series of vertical and oblique ties which restrain the separation of an intermediate sheet forming the bottom of the linked rows of chambers or tubes and the underlying bottom sheet of the plenum chamber from moving outward one from the other beyond a pre-determined distance. These ties (or stringers) in combination with the stacked rows of chambers or tubes prevent "hot dogging" of the air pallet when inflated, tend to reduce lateral shrinkage of the air pallet because of its anti-hot dogging and anti-ballooning effect, and increase the ability of the air pallet to accommodate surface irregularities when in motion so as not to create a point load problem, all of which increase the load stability of the particular air pallet.

The above various configurations and designs of air bearing pallets and patient movers have overcome or attempted to overcome, a number of the stability issues. However, there exists a further problem with air bearing pallets, when these devices are being transferred between two locations which are separated by a void region. The air being expelled from the air bearing pallet in order to generate the air film for ease of movement, can become less effective and may be substantially non-functional at this void location due to air pressure loss. This phenomenon may result in the grounding of load for example a patient, during transfer over this void region.

Therefore there is a need for a new air bearing pallet which can mitigate the potential loss of operation of the air bearing pallet during transfer over separations or void regions.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide an air bearing pallet, which is adapted to reduce air loss when the pallet is used to transfer a patient over a gap.

In accordance with one form of the present invention, an air bearing pallet, which is adapted for connection to an air source, includes an air bearing plenum chamber defined between a top sheet and a bottom sheet and a network of tethers oriented and connected between the two sheets. The tethers define a plurality of indentations at the bottom side of the bottom sheet upon inflation of the air bearing plenum chamber. The bottom sheet includes perforations there through at the indentations, thereby providing a plurality of air bearings and for the creation of an air film between the air bearing pallet and a support surface.

In one aspect, the bottom sheet is generally free of perforations adjacent the indentations.

In another aspect, the tethers are arranged in a random arrangement or geometric array, such as a close packed array.

In yet another aspect, the tethers are generally orthogonally oriented between the upper sheet and the bottom sheet, which will help maintain symmetry in the bladder when the bladder is inflated.

In other aspects, each of the tethers has a closed geometric cross-sectional shape.

According to other aspects, each of the tethers has approximately the same height. This will create indentations of approximately the same height. Alternately, at least two tethers have different heights to thereby vary the height of the indentations associated with the at least two tethers. For example, a group of adjacent tethers may have a shorter height than the remaining tethers wherein the indentations of the group of tethers form a larger common indentation when the air pallet is inflated and unloaded. In addition, when the larger common indentation is located at a central portion of the bottom sheet the larger common indentation may be used to form a pre-curve in the air bearing pallet when the pallet is inflated but unloaded.

In yet another aspect, at least two tethers have different elasticity. This may be also used to form a pre-curve in the pallet or may be used to vary the height of the indentation or to control tacoing, "hot dogging" or the like.

According to yet another aspect, the indentations form folds or creases in the bottom sheet. The creases are separated and spaced from the creases of an adjacent indentation wherein the creases of each indentation are not in fluidic communication with the creases of any other indentation. This helps reduce the air flow between the indentations and hence the air loss when an indentation is positioned over a gap or discontinuity, for example, between adjacent support surfaces.

According to another form of the invention, a patient air bearing pallet, which is adapted for connection to an air source, includes an upper sheet and a bottom sheet and an air bearing plenum chamber defined between the upper sheet and the bottom sheet. The bottom sheet includes a plurality of perforations there through, which are arranged and grouped to form a plurality of discrete air bearings upon inflation of the air bearing plenum chamber. The air bearings are arranged such that the bottom sheet substantially seals off each air bearing from an adjacent air bearing when that portion of the bottom sheet is resting on a support surface to thereby minimize loss of air through the air bearings when the pallet moves across a gap or discontinuity.

For example, the indentations may be arranged in a geometric array or a non-geometric pattern. Further, the indentations may have open or closed shapes, but in either case have shapes that are enclosed by a closed boundary. In this manner, the air bearings are not in fluid communication with each other when the bottom sheet is resting on the support surface and, further, only limited fluidic communication is available when the pallet is moved across a surface on the air film generated by the air bearings.

In one aspect, the indentations are formed by tethers that extend between the upper sheet and the bottom sheet. For example, the tethers may be generally orthogonally oriented between the upper sheet and the bottom sheet or arranged in a non-orthogonal orientation between the upper sheet and the bottom sheet. For example, the tethers may be arranged to fan outwardly from a central axis of the bottom sheet wherein the attachment points of the tethers to the upper sheet are offset relative to the attachment points of the tethers to the bottom sheet wherein the pallet can resist lifting up at its sides when loaded.

In another aspect, the upper sheet is formed from a material with a greater elasticity than the bottom sheet wherein the upper sheet has greater elongation than the bottom sheet to pre-curve the pallet when the pallet is inflated. This pre-curve can be used to eliminate the "tacoing effect" that can occur in inflated pallets when they are loaded.

In yet another form of the invention, a patient air bearing pallet includes an upper sheet and a bottom sheet and an air bearing plenum chamber defined between the upper sheet and the bottom sheet. A plurality of perforations are provided in the bottom sheet so that when the air plenum chamber is pressurized, the perforations form an air film between the pallet and a support surface. Further, the pallet is configured to form a concave configuration in at least a medial portion of the bottom sheet when the plenum chamber is pressurized to thereby pre-curve the pallet when the pallet is inflated.

In one aspect, at least a portion of the upper sheet is formed from a material with a greater elasticity than the bottom sheet wherein the upper sheet elongates more than the bottom sheet when the plenum chamber is pressurized.

In another aspect, the upper sheet and bottom sheet are interconnected by a plurality of tethers. For example, at least some of the tethers may be angled relative to other tethers to thereby pre-curve at least a portion of the pallet when the pallet is inflated. In another aspect, a group of adjacent tethers have lower heights than the remaining tethers such that the group of tethers form a common indentation at a medial portion of the bottom sheet to thereby pre-curve the pallet when the pallet is inflated.

Alternately, the group of adjacent tethers may have a lower elasticity that the surrounding tethers wherein the group of tethers form an enlarged indentation in the bottom sheet when the plenum chamber is pressurized, and the common indentation forming the pre-curve in the pallet.

According to yet another form of the invention, a patient air bearing pallet includes upper and bottom sheets and an air bearing plenum chamber defined between the upper and bottom sheets. The bottom sheet includes a plurality of perforations there through thereby providing for a creation of an air film between the air bearing pallet and a support surface. In addition, the pallet includes a plurality of tethers having connections at the upper sheet and at the bottom sheet. The tethers are arranged to fan outwardly from the central axis of the pallet such that the connections of the tethers to the upper sheet are offset relative to the connections of the tethers to the bottom sheet. This arrangement may be used to create a "precurve" in the pallet and/or used to help resist the "tacoing effect" when the pallet is loaded with a patient in the middle of the pallet.

In one aspect, the tethers form a plurality of spaced apart indentations in the bottom sheet. The indentations may be formed in a geometric array or a non-geometric pattern.

In a further aspect, the perforations are arranged and grouped in the indentations to form a plurality of discrete air bearings upon inflation of the air bearing plenum chamber.

Accordingly, the present invention provides a patient air bearing pallet that exhibits a reduce loss of air when the pallet is transferred over a gap or discontinuity. Further, the pallet can be configured to maximize the air film by controlling the shape of the pallet as it inflates.

These and other objects, advantages, purposes, and features of the invention will become more apparent from the study of the following description taken in conjunction with the drawings.

DETAILED DESCRIPTION OF THE INVENTION

Definitions

As used herein, the term "about" refers to a +/−10% variation from the nominal value. It is to be understood that such a variation is always included in any given value provided herein, whether or not it is specifically referred to.

Unless defined otherwise, all technical and scientific terms used herein have the same meaning as commonly understood by one of ordinary skill in the art to which this invention belongs.

The present invention provides an air bearing pallet that can be moved from one surface to another, such as from a bed to a stretcher, without losing the total air film due to the presence of a gap, resulting in performance failure of the pallet. The pallet comprises a network of tethers oriented and connected between top and bottom walls of a plenum chamber, which cause a system of indentations to become formed within the bottom exterior surface of the chamber when inflated. Perforations in the bottom wall enable air to escape thereby generating an air film below the chamber. The size, shape, depth, bottom surface tension/stiffness, airflow through, quantity and location of the indentations can be varied in order to optimize lifting performance and efficiency and reduce system level losses over irregularities and gaps in the support surface.

Overview of Air Bearing Pallet

Figure 1:
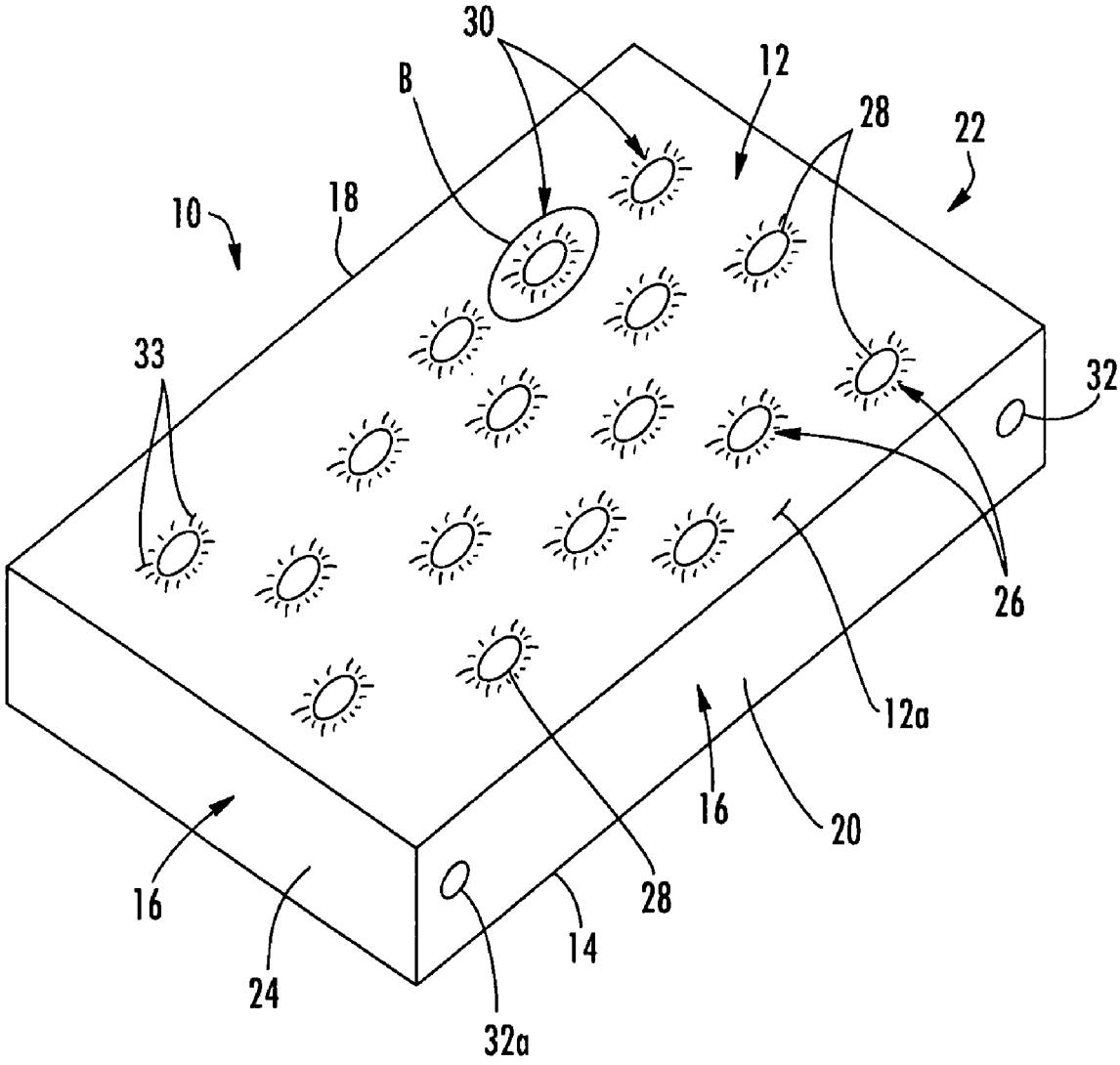
FIG. 1 illustrates a perspective view of an air bearing pallet according to one embodiment of the present invention.

FIG. 1 illustrates an air bearing pallet 10 of the present invention in a general form of an air mattress. Pallet 10 includes a bottom sheet 12, which forms a bottom surface 12*a*, and an upper sheet 14, which forms in this embodiment a top surface 14*a*. Sheets 12 and 14 are optionally joined together at their respective edges or are joined, as shown, by one or more strips of material 16, which form side walls 18 and 20 and end walls 22 and 24. Together sheets 12 and 14 and side walls and end walls define one or more plenum chambers for fluid, for example air, insertion therein. All of the material forming the sheets and walls are of flexible, substantially inelastic and substantially gas impermeable material, whereby air bearing pallet 10 may be folded or rolled to a compact condition when deflated. The height of the strips of material 16 may be varied and either may constitute the full sides or ends of the pallet when the pallet is inflated (such as shown in FIG. 1) or may form a portion of the sides or ends with portions of the top sheet and the bottom sheet forming the remainder of the sides or ends when inflated.

Air bearing pallet 10 further comprises a system of indentations 26 formed on the bottom surface 12*a* of the air bearing pallet. Each of the indentations (26) of the system comprise a series of perforations 28 for enabling the air within the air bearing pallet to escape and enable the creation of an air film between the bottom surface and a support surface, for example a floor, bed, stretcher, or cot. In this manner each of the indentations thereby substantially forms an air bearing for elevation 30 of the air bearing pallet relative to the support surface. This air film can provide for the reduction in the friction between the air bearing pallet and the support surface thereby decreasing the applied force required to the movement of the air bearing pallet over the support surface.

The air bearing pallet may be inflated and deflated through an opening or valve 32 therein which is coupled to a fluid source for inflation and maintenance of fluid pressure within the air bearing pallet during use. In one embodiment, a safety valve can be used which can function as a one-way valve, or self-sealing valve, which can allow air flow into the interior of the air bearing pallet. Therefore if, for example, the air source malfunctions, the air bearing pallet may still remain operational for a period of time, until air pressure therein decreases to an inoperative level. In one embodiment an outlet 32*a* which is in fluidic communication with the interior of the air bearing pallet can be provided for deflation, wherein this outlet can be configured with a wide opening for fast deflation.

In one embodiment of the present invention, the air bearing pallet comprises one or more plenum chambers, wherein multiple plenum chambers may be stacked upon one another. In this configuration, the air bearing pallet can be seen as comprising two stacked sections, wherein the top plenum chamber can provide load support and the bottom plenum chamber can be configured to provide the air bearings, namely the air bearing plenum chamber, for movement of the air bearing pallet over the support surface. Further details of an air bearing pallet with multiple plenums will be more fully described below in reference to FIG. 19.

System of Indentations

Figure 1A:
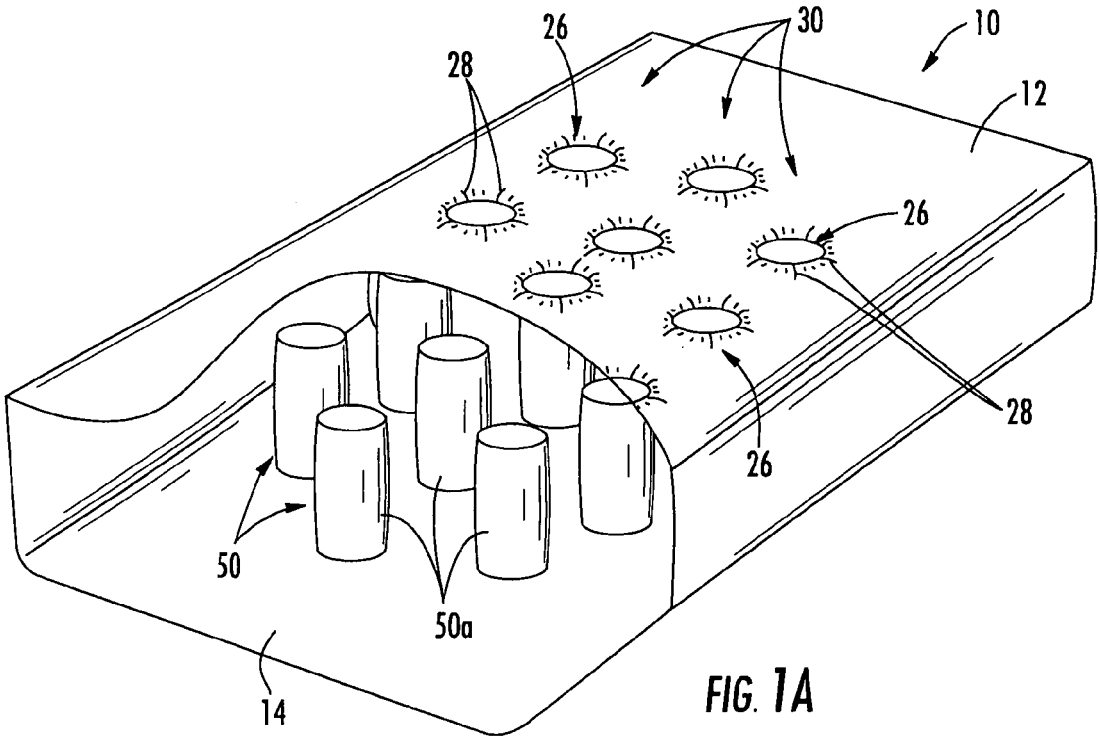
FIG. 1A is a partial fragmentary perspective view of the pallet of FIG. 1.

Referring to FIGS. 1 and 1A, the plurality of independent air bearings (30) are defined by the plurality of indentations 26, which are configured in the bottom surface of the air bearing pallet. Air bearings 30 form a system of air bearings that creates an air film to allow easier transfer of a patient but reduces the air loss from the air bearings when the pallet is moved over a gap or space. As noted, each indentation 26 is designed with a plurality of perforations 28 therein, which provide a means for creating a localized volume of higher pressure air which is greater than ambient surroundings, which can be used to lift the air bearing pallet away from the support surface thereby decreasing system friction. The size, shape, depth, matt surface tension/stiffness, airflow through, quantity and location of the indentations can be varied in order to optimize lifting performance and efficiency and reduce system level losses over irregularities and gaps in the support surface.

As best seen in FIGS. 1 and 1A, the air bearings are spaced apart from each other so that they are not in fluid communication with each other when the bottom sheet of the pallet is resting on a surface. As would be understood, the indentations (26) are arranged and spaced apart so that the folds or creases 33 in the sheets (12 or 14), which typically occur when the sheets are pulled inwardly at an indentation, are not in fluidic communication with the creases of an adjacent indentation when that portion of the air bearing pallet is resting on a surface.

Figure 2F:
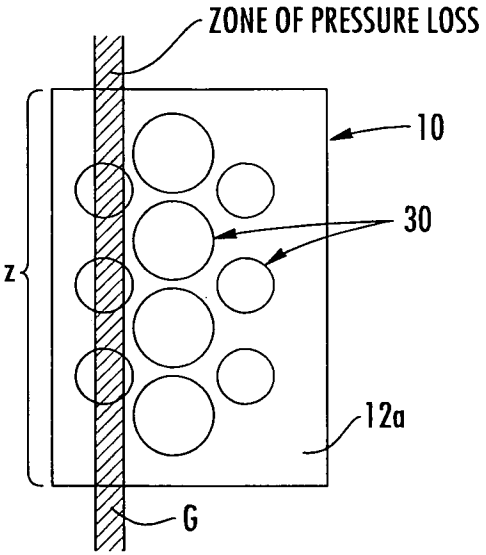
FIGS. 2D-2F are plan views of the air bearing pallet of the present invention, illustrating zones of pressure loss upon passage over a gap between two adjacent support surfaces.
Figure 2E:
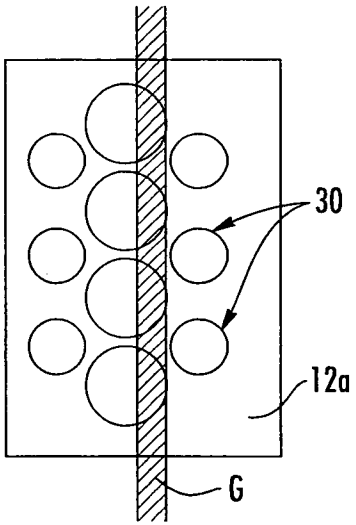
Figure 2D:
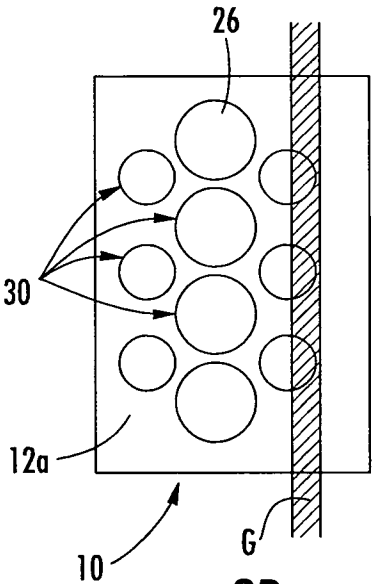
Figure 2C:
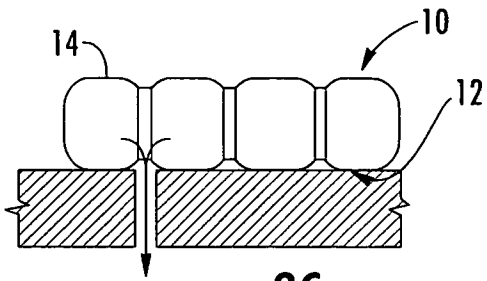
FIGS. 2A-2C are end elevation views of the air bearing pallet of the present invention illustrating the flow of air from the air bearings as they traverse a gap or discontinuity between two support surfaces.
Figure 2B:
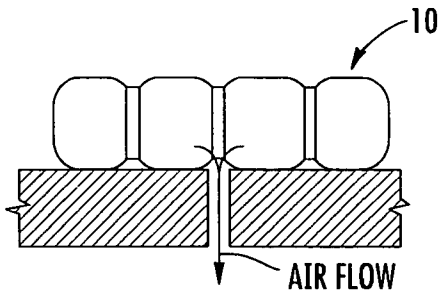
Figure 2A:
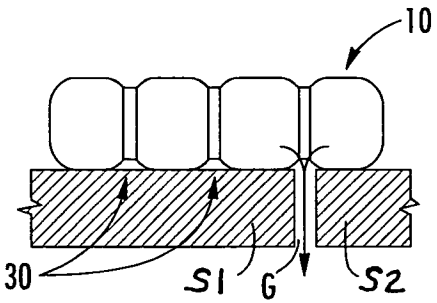

Referring to FIGS. 2A-2C, when air pallet 10 is lifted off or moved off one support surface S1 and moved to an adjacent support surface S2 that is spaced from the first support surface that portion of the bottom surface of the pallet that is aligned over the gap G between support surface S1 and S2 will allow air to flow from the air bearings aligned over the gap. Further, there may be some reduced fluidic communication between the adjacent air bearings (30). But this fluidic communication from the adjacent air bearings (30) is terminated once that portion of the bottom surface is again resting on a support surface. The result is that the surface area of bottom sheet 12 surrounding each indentation forms a closed volume at the indentation when the pallet is resting on a support surface. Further, the surfaces surrounding the indentations form a network of surfaces that can seal around the indentations that are located over a support surface when those surfaces are resting on a support surface, which reduces air loss when the pallet is moved across a gap, such as gap G between support surfaces S1 and S2.

Referring to FIGS. 2D-2E, when an air bearing pallet according to the present invention passes over a gap or separation in the support surface, a zone of pressure loss is created that can be defined by summation of the indentations in the bottom surface that are bisected by the separation or gap. Depending on the configuration of the indentations of the air bearing pallet, this region of loss of lift can be configured to reduce the effect the separation in the support surface has on the operational characteristics of the air bearing pallet. For example, FIGS. 3A-3E illustrate a number of different indentation array configurations and a changing zone of air loss, as would be associated with a separation or gap having a width W in the support surface. An indentation that falls partially or entirely within the separation region will have a loss of lifting ability. Therefore, the configuration of the system of indentations in the bottom surface of the air bearing pallet can be defined in order that a separation of a predetermined width can have a limited effect on the desired functionality of the air bearing pallet.

Figure 3:
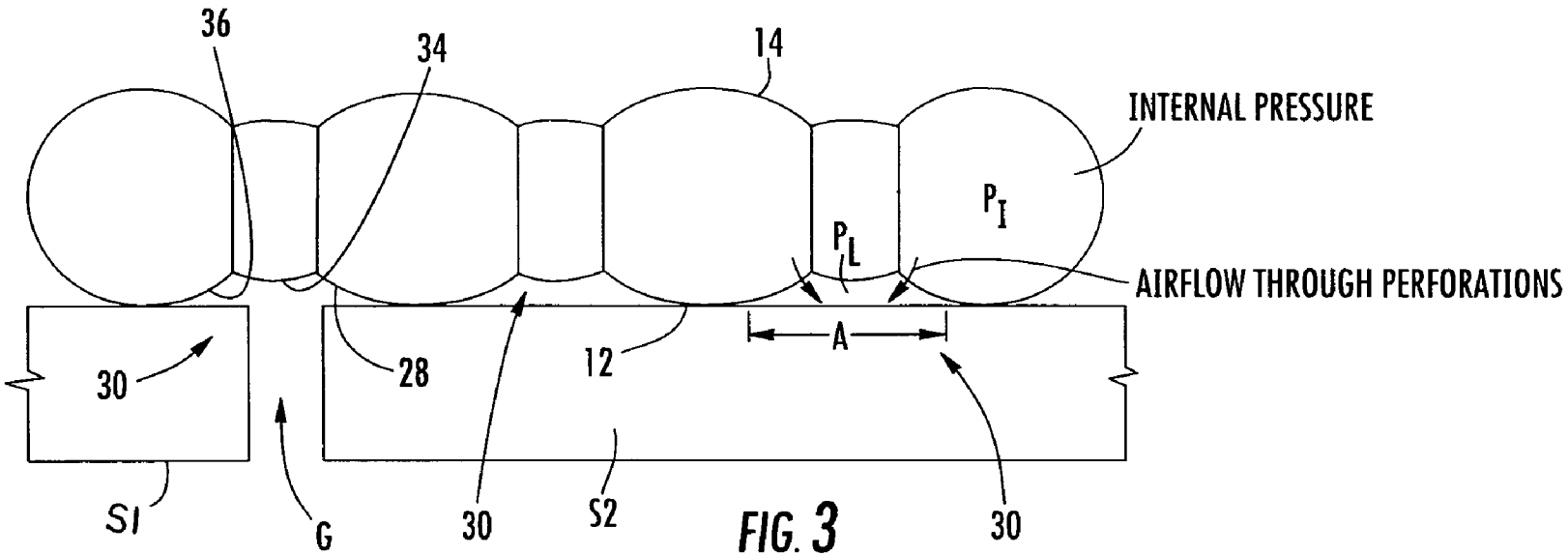
FIG. 3 illustrates an enlarged view of FIG. 2F.
Figure 3A:
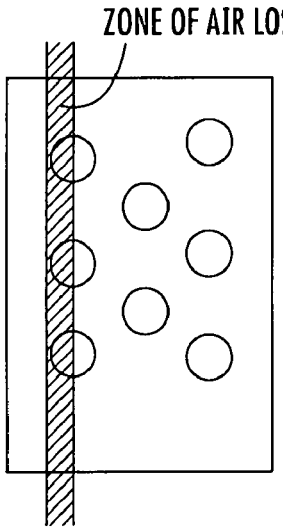
FIGS. 3A-3E illustrate different indentation patterns and the effect on the zone of air loss.
Figure 3B:
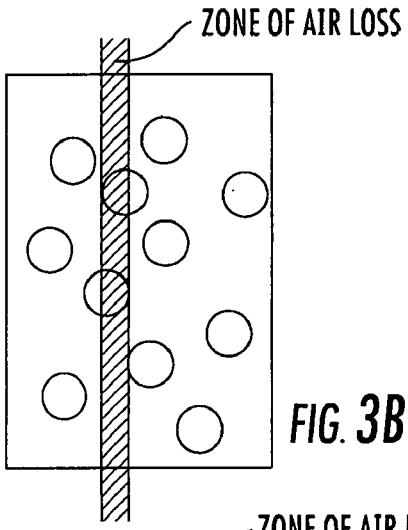

In addition, the perforations within an indentation can be positioned at a plurality of locations within the indentation. For example as illustrated in FIG. 3, the perforations can be positioned at the top of the indentation 34 or along the sides of the indentation 36, wherein these sides are created upon inflation of the air bearing pallet. Perforations 28 provide a means for generation of the localized lifting pressure $P_L$ for generating an air film for reduction of friction between the air bearing pallet and the support surface.

The configuration of the array of independent air bearings or system of indentations is designed in order to ensure that a desired level of lift pressure is maintained on a substantial portion of the air bearing pallet even when irregularities or gaps in the support surface are encountered. For example, the summation of the lifting forces ($P_L$) generated by each of air bearings 30 can provide an approximation of the potential lifting force for the air bearing pallet. With reference again to FIG. 3, the lifting force ($P_L$) generated by an air bearing 30 is equivalent to the pressure within an indentation $P_L$ multiplied by the area A of the support surface exposed to that lifting pressure. For example, the flexibility of the bottom surface among other considerations can result in a reduction in the potential lifting force that can be generated by a particular indentation.

Referring again to FIGS. 3A-3E, the system of indentations may be configured in a regularly spaced, randomly spaced, or regional density array. For example, a system of indentations having varying spacing densities of indentations in predetermined regions can provide for variations in localized lifting efficiency of the air bearing pallets. For example, predetermined regions of the air bearing pallet typically require an increased bearing capacity when this region defines an intended region for load positioning, for example in the central region of the pallet. Therefore a greater density of indentations can be positioned in this central region of the air bearing pallet for increased lifting capacity in this region. This adjustment in the regional density of the indentations can further provide a means for controlling over lifting in regions of lower load applications for example along the perimeter of the air bearing pallet. This over lifting may result in an undesired lifting or tacoing effect of the perimeter of the air bearing pallet which may adversely effect the lifting capacity of other indentations.

Figure 4A:
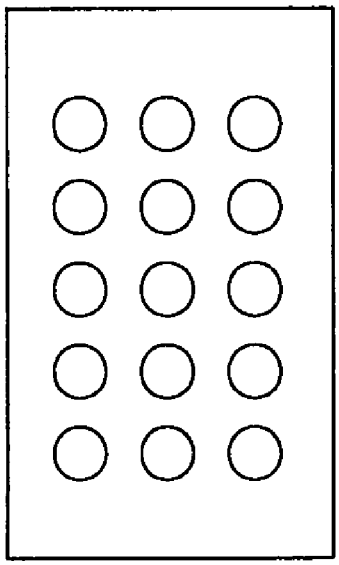
FIGS. 4A-4D illustrate further indentation arrangements.
Figure 4B:
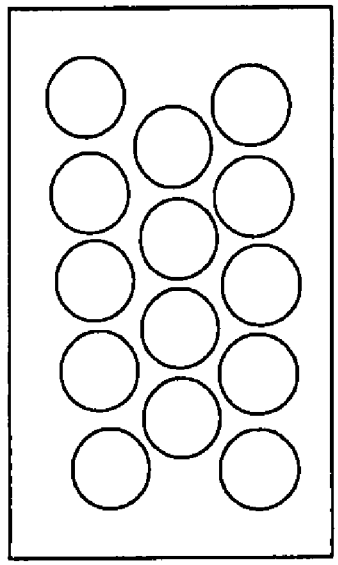
Figure 4C:
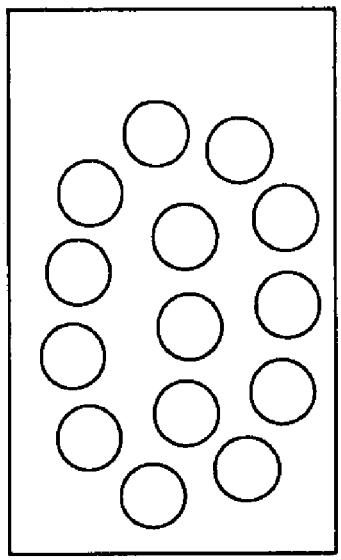

In one embodiment of the present invention, the indentations are arranged in a regular or geometric array (FIG. 4A), such as a grid or orthogonally shaped pattern within the bottom surface of the air bearing pallet. Alternatively, the indentations can be configured in a hexagonal close packed array (FIG. 4B), octagonal, circular, curvilinear (FIG. 4C) or other geometric pattern within the bottom surface of the air bearing pallet.

Figure 4D:
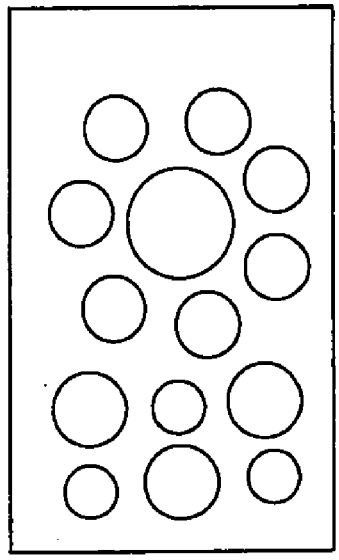
Figure 5A:
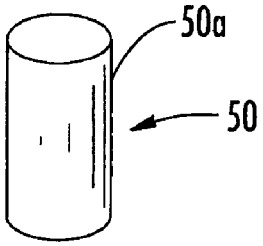
FIG. 5A illustrates a perspective view of a tubular tether of one embodiment of an air bearing pallet.

In another embodiment of the present invention, the system of indentations can be provided in the bottom surface of the air bearing pallet in a random configuration as illustrated in FIG. 4D. In this configuration of the system of indentations, the performance of the air bearing pallet during operation and transfer over a support surface can be substantially independent of the relative orientation of air bearing pallet and any irregularities, for example gaps or separation regions in the support surface.

The shape and size of an indentation can also be configured to be the same over the entire bottom surface of the air bearing pallet, or can vary in a predetermined or random manner, also shown in FIG. 4D. The size and shape of the indentations of a system of indentations may be dependent on the intended density of the indentations over a portion or the entire bottom surface of the air bearing pallet. For example, the cross-sectional shape of the indentations can be configured as closed geometric shapes, such as circles, ellipses, hexagons, octagons, or curvilinear shapes or any other regular or irregular closed shape as desired. For example, indentations having a hexagonal cross-sectional shape may provide a means for closely packing of indentations over the bottom surface of the air bearing pallet. As noted and best seen in FIG. 1, in preferred form, the cross-sectional shape of the indentations is a closed shape and therefore bounded by a closed boundary B, which provides a closed volume for the indentation when the pallet is resting on a support surface.

The size and configuration, for example length, width, depth and axial and longitudinal cross-sectional shapes of an indentation is controlled by a tether which links the bottom surface of the air bearing plenum chamber to the top surface of air bearing plenum chamber. A network of tethers provides means for the generation of the system of indentations upon the inflation of the air bearing plenum chamber.

Network of Tethers

A tether refers to a means of connection between the top and bottom sheets 12, 14 within the defined perimeter. The effect of a network of tethers on the air pallet causes the two surfaces to form an array of uniform or non-uniform indentations upon inflation. Perforations in the bottom sheet located within the indentations create the air film between the indentations and the support surface.

In one embodiment, a tether (50) is formed from a substantially inelastic but flexible sheet of material which enables the generation a tensile force therein with minimal elongation. In an alternate embodiment of the present invention, the tether may be formed from a flexible, substantially elastic material. The fabric characteristics of the tethers, whether formed from a sheet material that is non-flexible, flexible and/or thin, affect the shape of the pallet. As will be more fully described below, the characteristics of the upper and bottom sheets and sides, as well as portions of the upper and bottom sheets and sides, also may vary. For example, stretch may be provided in any direction or in a selected direction in the tethers, upper sheet, bottom sheet, or sides.

In addition, the indentation configuration can be controlled by the tether location relative to other indentations as indentation geometry and boundaries are affected by the local topography and surface tension of the bottom surface which can be created by adjacent indentations.

In addition, indentation configuration can be controlled by tether length, which can affect the depth of an indentation as well as the interrelation of adjacent indentations. For example, when a short tether is positioned relatively close to a longer tether, the indentation generated by the short tether can be deeper than that created by the longer tether. This difference in depth of an indentation can result in a difference in the volume defined by an indentation and a difference in the area of the support surface in contact with the indentation, which can result in differing lifting forces for the indentations.

Figure 6A:
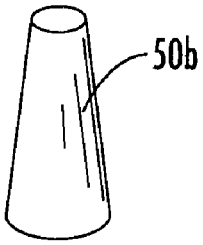
FIG. 6A is a perspective view of a tether with a varying cross-section.
Figure 7A:
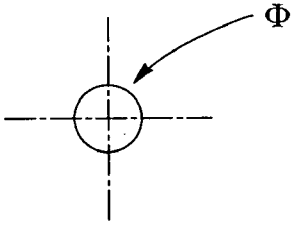
FIG. 7A illustrates a cross-section of the tethers of FIGS. 5A and 6A.
Figure 7B:
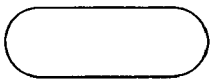
FIG. 7B illustrates an alternate cross-section for the tethers of FIGS. 5A and 6A.
Figure 7C:
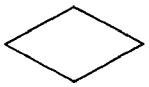
FIGS. 7C-7E illustrate further alternate cross-sections for the tethers of FIGS. 5A and 6A.
Figure 7D:
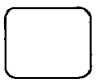
Figure 7E:
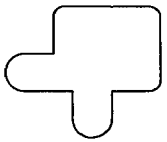

The geometry of a tether attachment to the top sheet and bottom sheet of the air bearing plenum can take a number of geometric shapes. Referring to FIG. 1A, tethers 50 may be configured as closed geometric shapes, which form hollow tubular structures 50*a* having cross-sectional shapes including round (FIG. 7A), oval (FIG. 7B), or multi-sided, such as diamond (FIG. 7C), square, or rectangular (FIG. 7D),or any other desired cross-sectional shape, including a non-geometric shape (FIG. 7E). As best seen in FIG. 6A, these hollow shaped tethers can further have varying cross-sections over their height. For example they can be configured as cones (50*b*, see FIG. 6A), pyramids, frustums or other shapes as would be known to a worker skilled in the art. As best seen in FIG. 1 (and FIG. 18A), when the tether has a closed cross-sectional shape, the perforations are arranged around the seam between the tether and boundary B of the air bearing 30, leaving an area inside the seam with no perforations. Though it should be understood that the area inside the seam may be provided with perforations provided that the tether has perforations or passageways to allow air into the inside of the tether.

Figure 8A:
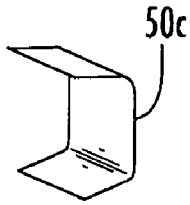
FIG. 8A is a perspective view of tether with an open cross-section.
Figure 9A:
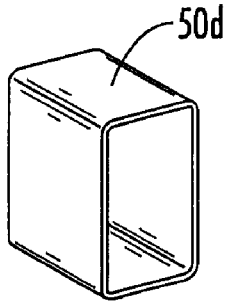
FIG. 9A is a perspective view of a loop-shaped tether.
Figure 10A:
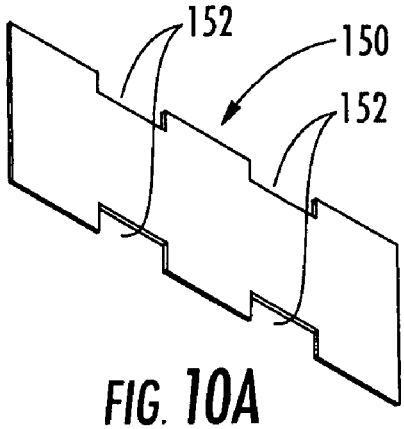
FIG. 10A is a perspective view of yet another tether of the present invention.
Figure 8B:
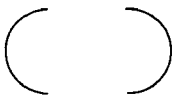
FIGS. 8B-8D illustrate various open cross-sections of tethers arranged in pairs.
Figure 8C:
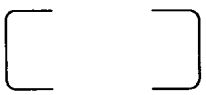
Figure 8D:
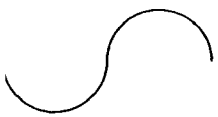

In another embodiment of the present invention, a tether is configured as an open geometric shape, for example a strip (FIG. 8A), loop (FIG. 9A) or other open geometric shape as would be readily understood. Alternately, the tethers can be configured as a random shape, such as shown in FIG. 8D. FIGS. 8A, 9A, and 10A illustrate the tether configured as a linear strip, loop and interrupted strip, respectively. As best seen in FIG. 8A, the upper and lower portions of the linear strip can provide a means for securing the tether to the desired locations at the top sheet and bottom sheet in the air bearing plenum chamber.

Further, the connections of the open geometric shaped tethers to the top and bottom sheets may be similar to the connections of closed geometric shaped tethers—that is, they may be round, oval, or multi-sided, such as diamond, square or rectangular, or any other desired shape, including a non-geometric shape. In addition, the open geometric shaped tethers may also have varying cross-sections over their height, for example, they may be tapered. When the tether has an open cross-sectional shape and is formed from a loop, the perforations are also typically located outside the perimeter of the connection, though they may also be located on the inside of the connection to thereby provide perforations that would extend across the indentation, but these perforations would not provide air flow unless that lower portion of the loop that connects the tether to the bottom sheet is also perforated. Further, tethers 50 may be arranged and grouped together, such as shown in FIGS. 8B and 8C, to form a common indentation.

The interrupted strip 150 may provide a means for air transfer perpendicular to its position due to the openings 152 provided therein.

The indentations that are created on the bottom surface of the air bearing pallet can be dependent on the pattern of the connection of the tethers to the bottom sheet and top sheet of the air bearing plenum chamber. For example, the top and bottom sheets may have different size indentations, have differently shaped indentations, and have indentations at different locations. It should be understood from the foregoing that the tether attachment locations, the type of connections, the tether size, the tether length, the tether orientation, the tether shape, and the tether elasticity may be varied and used to configure and manage the size and geometry of an indentation.

The configuration of the network of tethers can provide a means for controlling the three dimensional shape of the air bearing pallet. For example, the network of tethers can be configured to manage ballooning and pillowing of the air bearing pallet.

Figure 3D:
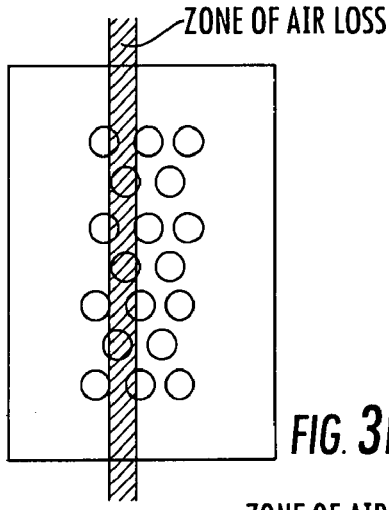
Figure 3C:
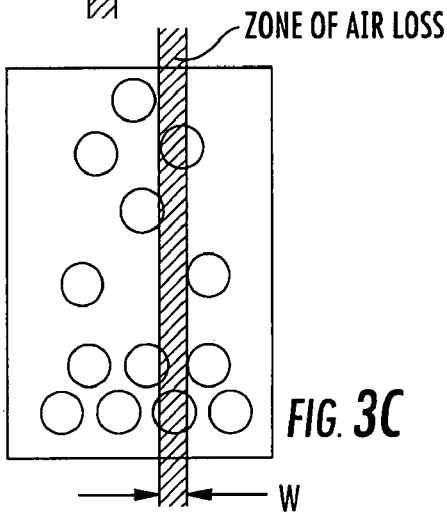
Figure 3E:
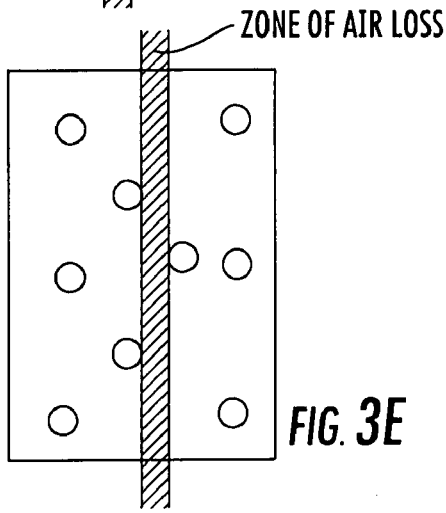

In one embodiment of the present invention, the network of tethers is further configured to generate a system of indentations in the bottom surface of the air bearing pallet, such that the density of the indentations is substantially below the load placed upon the air bearing pallet, such as shown in FIG. 3D.

As would be understood, therefore, the tethers can be arranged in a pattern that can manage body weight and pressure distribution of the load placed upon the air bearing pallet.

In one embodiment of the present invention, the attachment positioning of the tether network to the upper and bottom sheets of the air bearing plenum chamber can be symmetric about the horizontal centre line of air bearing plenum chamber upon inflation thereof. Where the tether attachment is identical in placement between the upper and bottom sheets, a symmetry about the horizontal center plane of the pallet is created when inflated.

In another embodiment of the present invention, the attachment positioning of the tether network to the upper and bottom sheets of the air bearing plenum chamber has positional variations in the longitudinal and/or transverse directions of the air bearing plenum chamber upon inflation thereof, which can create a non symmetrical shape about the horizontal center plane of the pallet. This format of attachment positioning of the tethers can be adapted to provide system level management of performance, for example can provide a means for maintaining indentation contact with the support surface irrespective of the load and associated distribution thereof, for example. For example, the relative attachment positioning of the tether network between the upper and bottom sheets of the air bearing plenum chamber can provide a means for the reduction of tacoing of the air bearing pallet.

Figure 11B:
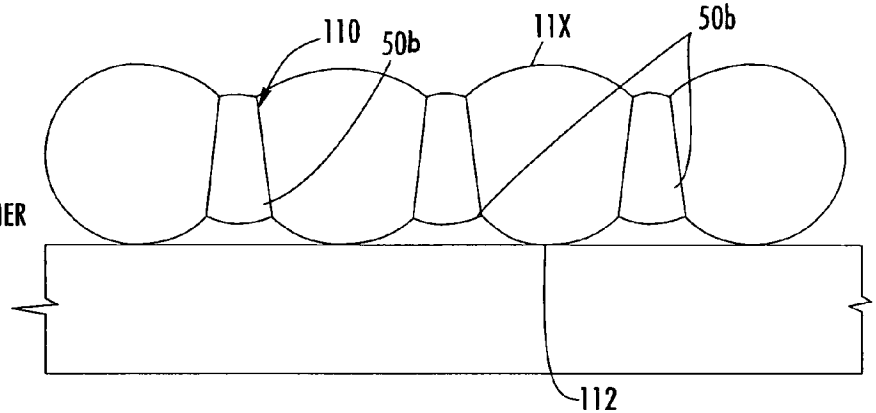
FIGS. 11A-11D are cross-sections of various pallets with different networks of tethers.
Figure 11D:
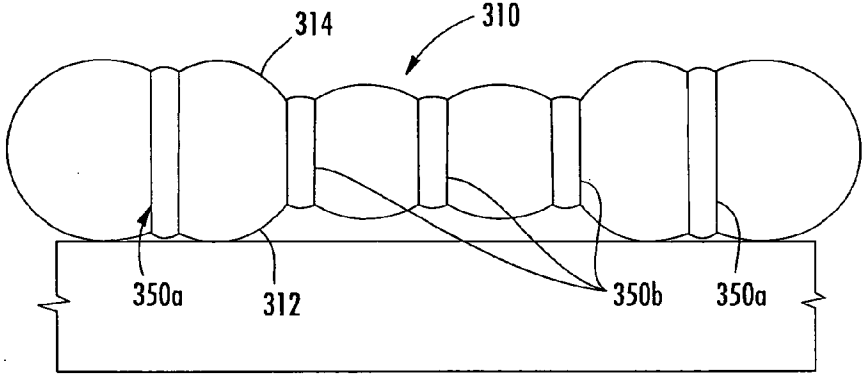
Figure 11A:
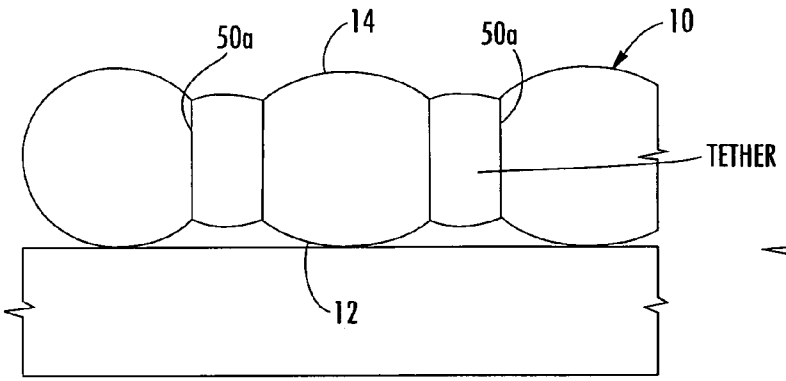

Referring to FIG. 11A, pallet 10 is illustrated with tethers of general equal height and spacing. As noted above, the tethers may be selected and arranged to vary the shape of the upper surface or bottom surface of the pallet. Referring to FIG. 11B, pallet 10 includes a plurality of tapered tethers 50*b*, which are oriented such that their smaller cross-section is connected to the upper sheet 114 and their larger cross-section is connected to the bottom sheet 112, which provides different topographies for the upper and bottom sheets.

Figure 11C:
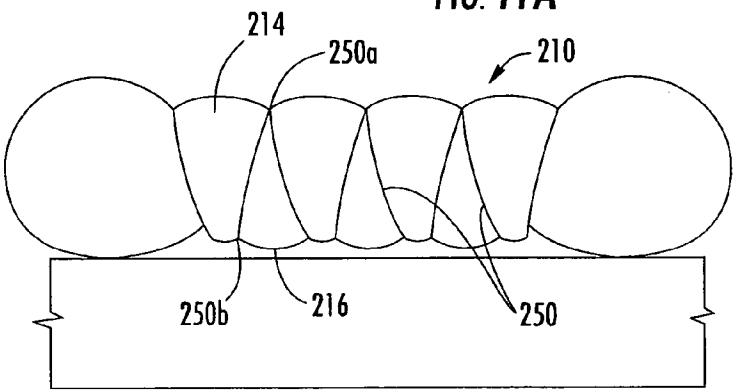

Referring to FIG. 11C, pallet 210 also includes a plurality of tethers 250 that have an upper end that connects to the upper sheet 214 that varies from its lower end that connects to the lower sheet. In the illustrated embodiment, each tether 250 connects at a point or line 250*a* to the upper sheet but connects to the bottom sheet with an enlarged cross-sectional portion 250*b* so that there may be even greater variation between the depth and size of the indentations between the upper sheet and the bottom sheet.

Further, referring to FIG. 11D, pallet 310 includes tethers 350*a* and 350*b* with different heights when inflated. This may be achieved through different lengths of the tethers or may be achieved through the tethers having different elasticity and, therefore, different elongation. As previously noted, the tether length affects the depth of the indentations. Further, the tethers may be arranged in groups, as shown in FIG. 11D, so that when the pallet is inflated but unloaded, the indentations may form a larger common indentation, which can be used to precurve the pallet. When the pallet is then loaded, the pallet will deflect at its medial portion to create a cradle for a patient supported thereon.

Tethers and Tacoing

Figure 12:
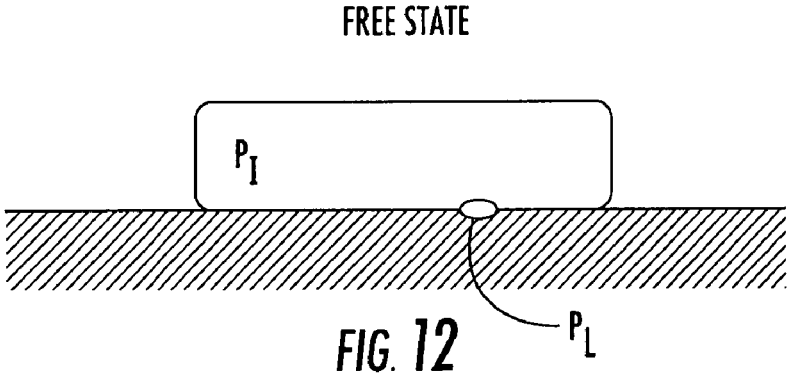
FIG. 12 is an elevation view of an air bearing pallet according to one embodiment of the present invention in an unloaded configuration.
Figure 13:
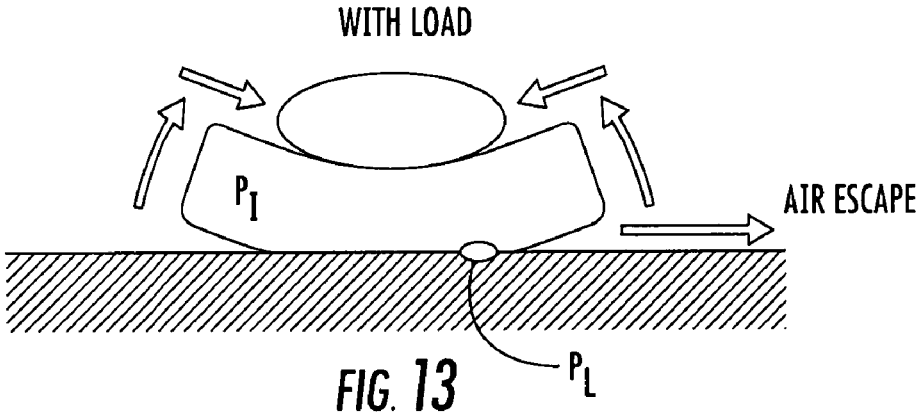
FIG. 13 is an elevation view of an air bearing pallet according to one embodiment of the present invention in a loaded configuration.

FIG. 12 illustrates an air bearing pallet according to any of the embodiments of the present invention. When a load is placed on the top surface of an air bearing pallet, the resulting immersion of the load therein deforms the top surface pulling the sides of the air bearing pallet in and thereby pulling the bottom surface up at the perimeter of the pallet resulting in the bottom surface potentially being elevated above the support surface as illustrated in FIG. 13.

Figure 14:
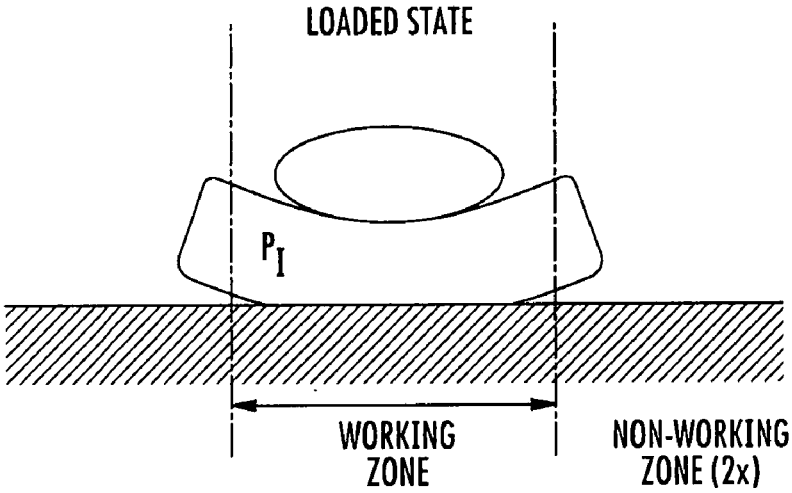
FIG. 14 is an elevation view of an air bearing pallet according to one embodiment of the present invention in a loaded configuration illustrating a working zone and a non-working zone.

When the sides are drawn in and up, the ability for the system to contain the fluid within the indentations is lessened, and therefore the working zone, namely the zone of indentations remaining in contact with the support surface, is decreased as shown in FIG. 14. As the load placed upon the air bearing pallet increases, the immersion can increase thereby potentially worsening the drawing up of the bottom surface of the air bearing pallet.

The performance of the air bearing pallet can be somewhat decreased by this tacoing effect. This reduction in performance is due to losses of lift pressure due to increased flow outside the indentations or air bearings, resulting in lift pressure thereby resulting in the air bearing pallet dropping closer to the support surface increasing the friction between the bottom surface and the support surface.

In one embodiment of the present invention, the indentations can be concentrated in the working zone region thereby limiting the loss of lift forces due to the tacoing effect of the air bearing pallet.

Figure 15:
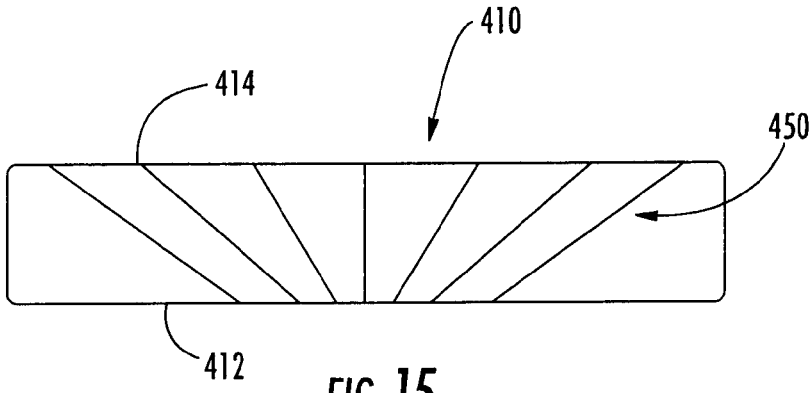
FIG. 15 is a cross-sectional view of another embodiment of an air bearing pallet according to the present invention.

In another embodiment of the present invention, the configuration of the tethers can provide a means for managing this tacoing effect. For example, referring to FIG. 15, pallet 410 includes a network of tethers (450) configured in a fan shape. The tethers fan outwardly from the center axis along the longitudinal direction of the pallet so that the attachment points of the tethers to the upper sheet are offset and further spaced further apart than the attachment points of the tethers to the bottom sheet as illustrated in FIG. 15. Thus, the upper sheet 414 and the bottom sheet 412 are coupled by the network of tethers 450, which configuration can provide a means for restraining the lifting of the bottom surface from the support surface during use of the air bearing pallet.

Figure 16:
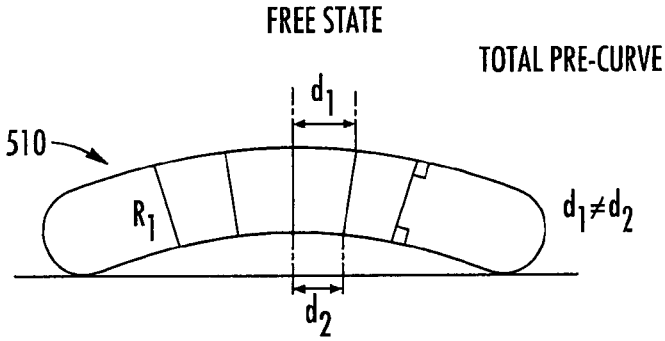
FIG. 16 is a cross-sectional view of an air bearing pallet according to the present invention configured with a pre-curve.

In yet another embodiment, pallet 510 (FIG. 16) includes a network of tethers that is configured as a fan shape and further where the length of the tethers is configured to generate a pre-curved configuration of the air bearing pallet upon initial inflation and prior to load application. In this manner upon application of the load to the air bearing pallet, this pre-curve will be reduced and the system of indentations generated by the network of tethers can provide the desired level of lift for movement of the load.

In an alternate embodiment of the present invention, a pre-curved air bearing plenum chamber can be created by using materials with different elastic properties for the top and bottom surfaces. For example, if the bottom sheet is less elastic than the top sheet, upon inflation of the air bearing plenum chamber a precurve can be created as the top sheet is capable of more elongation than the bottom sheet. Further, materials with different elastic properties may be used in discrete areas on either or both surfaces to achieve a desired shape, including, for example, at the indentations. Where a more elastic material is used at the indentation, the shape, depth, and/or size of the indentation may be varied. In addition, where the material forming the indentation is more elastic than the balance of the sheet, the indentation may be formed without creases, which may provide for a greater control over the shape of the indentation. This variation in material forming the pallet may be particularly suitable in a disposable application where it may be desirable to have the same tethers through the pallet for cost considerations while achieving greater control over the shape of the pallet.

In one embodiment of the present invention, the level of the pre-curve can be defined for predetermined load ranges. For example a particular air bearing pallet can be configured to transfer a load between about 150 lbs and about 200 lbs and an alternate air bearing pallet can be configured to transfer a load between about 200 lbs and about 250 lbs. This configuration can be determined based the design of the network of tethers, relative size of the top surface to the bottom surface and the relative elasticity between the top surface and the bottom surface.

Figure 17:
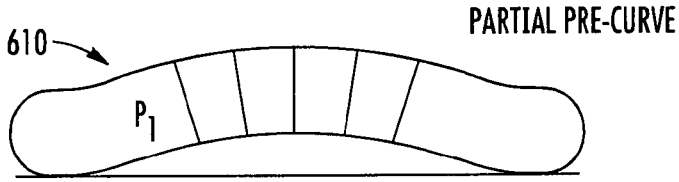
FIG. 17 is a cross-sectional view of an air bearing pallet according to the present invention configured with a partial pre-curve.

Referring again to FIG. 16, pallet 510 includes a full pre-curve configuration of the air bearing pallet upon inflation. As best seen in FIG. 17, pallet 610 includes a partial pre-curve configuration. In each of these examples, the top surface is elongated relative to the bottom surface.

In an alternate embodiment of the present invention, in order to control the tacoing effect, a semi-rigid or rigid layer can be positioned on the top of the air bearing pallet.

Construction of the Air Bearing Pallet

The material for the top surface, bottom surface, side walls and end walls can be formed from a flexible and resilient material, such as polyvinyl chloride sheeting (PVC), thermoplastic impregnated cloth or other materials known to one of ordinary skill in the art. The edges of mating surfaces and walls can be fused using such processes as radio frequency (RF) welding, ultrasonic welding, heat welding or other processes known to one of ordinary skill in the art. In addition, the connection of the network of tethers to the desired locations of the air bearing pallet, in order to define locations of indentation formation, can be performed in a similar manner. Alternately, depending on the material used for fabrication of the air bearing pallet, a mechanical coupling technique, for example, sewing can be used for connection of one or more of the surfaces, walls or ends to one another, and in addition to the coupling of the tethers to the device. While sewing can result in punctures within the material, the losses that are created are normally acceptable—with a possible impact of a reduction in efficiency.

The material used for the top and bottom surfaces, side and end walls can be a substantially inelastic material, which is substantially impervious to fluid penetration. While the material is substantially inelastic, the material is configured to be capable of a predetermined amount of elastic deformation during use and operation of the air bearing pallet.

In one embodiment of the present invention, as the bottom surface of the air bearing pallet is passing over the support surface, which may comprise a number of irregularities therein, this bottom surface can be configured to have a predetermined resistance to tearing or other failure of the material. For example, the bottom surface can be designed having a thickness greater than other portions of the air bearing pallet, in order to account for the potential of additional wear and abrasion on the bottom surface of the air bearing pallet.

In another embodiment of the present invention, the bottom surface of the air bearing pallet is coated with a friction reducing compound, for example Teflon™ or other material in order to further reduce friction between the air bearing pallet and the support surface during movement of the air bearing pallet.

Figure 18A:
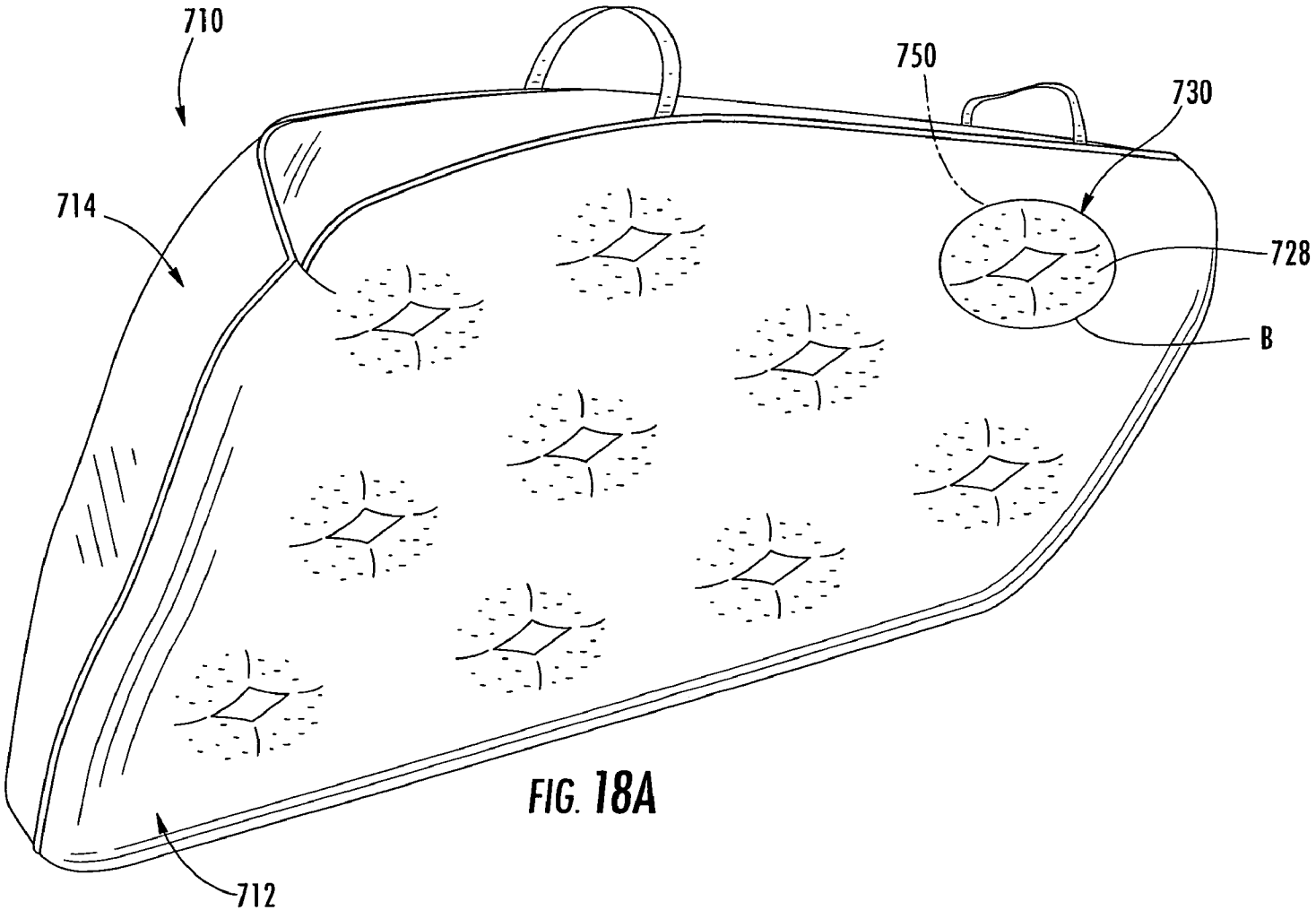
FIG. 18A is a bottom perspective view of another embodiment of an air bearing pallet of the present invention.

As noted in reference to FIGS. 1 and 1A, air bearing pallet 10 is illustrated as having discrete side and end walls. However, as best seen in FIG. 18A, air bearing pallet 710 may includes upper and bottom sheets 714, 712 that are joined directly to one another at the ends of the pallet, while the sides of the pallet may still be formed by strips or bands of material that are joined to the edges of the upper and bottom sheets. Further, in the illustrated embodiment, the air bearings 730 are formed by tethers 750 with rectangular shaped cross-sections so that the seam between the tethers 750 and the bottom sheets have rectangular configurations. Again, the perforations are arranged in the indentation around the seams but are enclosed or bounded by closed perimeter or boundary B.

Figure 18B:
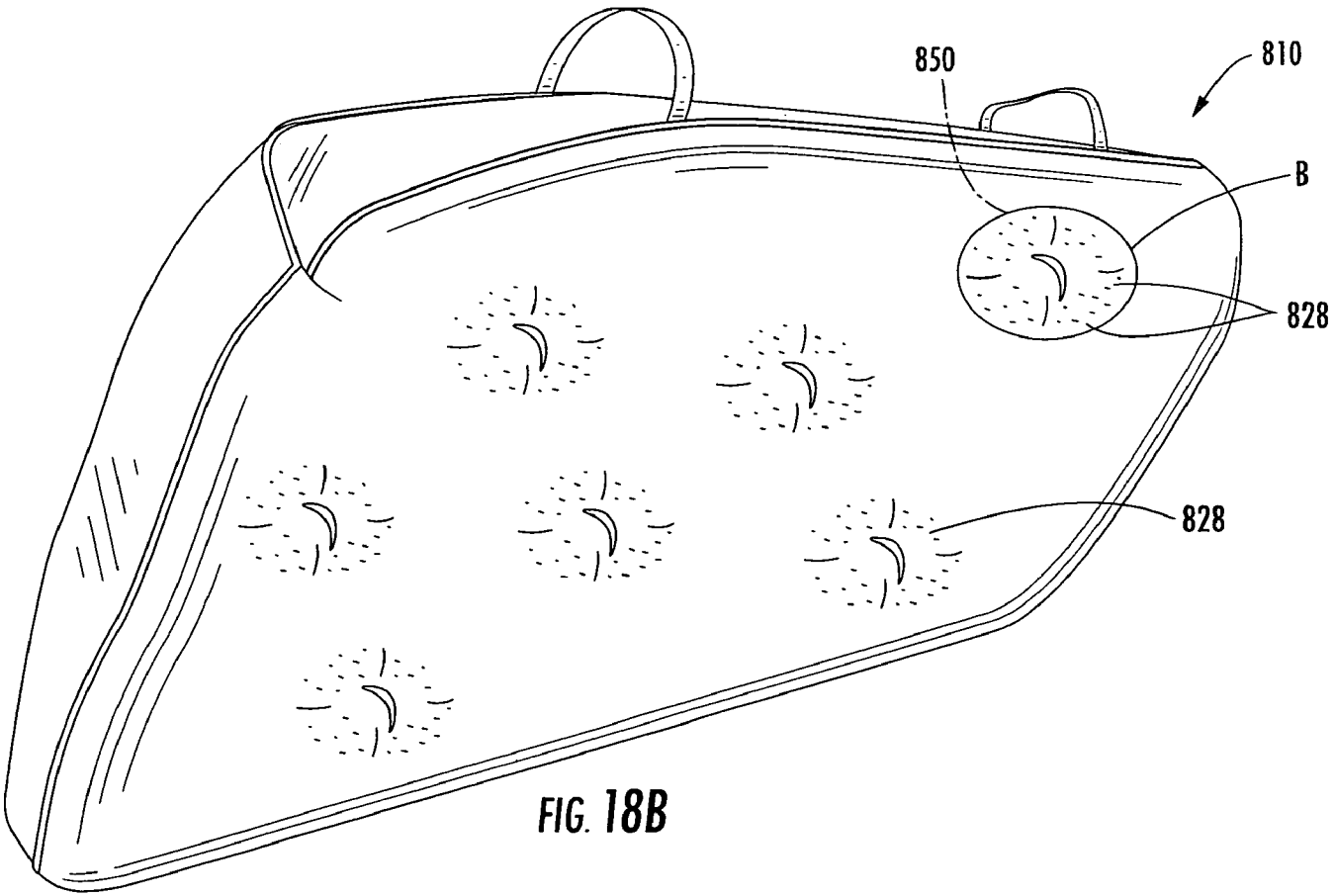
FIG. 18B is a bottom perspective view of another embodiment of an air bearing pallet of the present invention.

Referring to FIG. 18B, pallet 810, which is of similar constructions to pallet 710, includes tethers 850 with open shapes, but which still create a closed geometric-shaped indentation bounded by a closed perimeter or boundary B. Again, perforations 828 are preferably located within the boundary B.

In one embodiment of the present invention, the top surface of the air bearing pallet will be the exterior side of the top wall, for example when the air bearing pallet is configured as a rectangular box, similar to that of a mattress.

Figure 19:
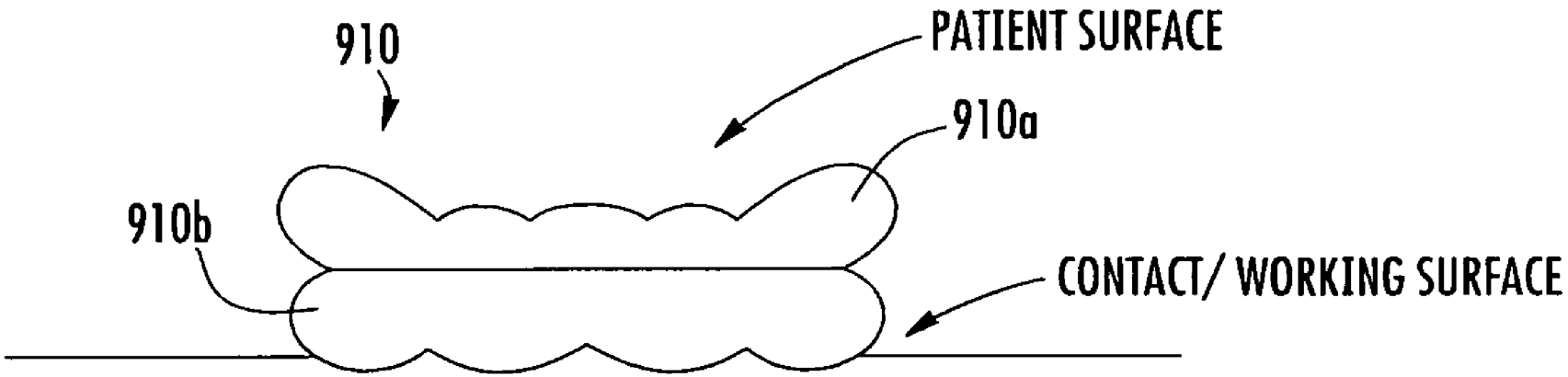
FIG. 19 is a cross-sectional view of an air bearing pallet incorporating two stacked plenum chambers.

Referring to FIG. 19, air bearing pallet 910 includes two air plenum chambers 910*a*, 910*b* in a stacked configuration. In this arrangement, top plenum chamber 910*a*, which does not include perforations, sits upon the lower air bearing plenum chamber 910*b*, which has a system of indentations therein. This system of indentations may assume any one or combination of the systems described herein. In this configuration, the top plenum chamber 910*a* provides for load support and the bottom plenum chamber 910*b* provides the air bearings for movement of the air bearing pallet. It should be understood that additional plenum chambers can be added to the stack to provide a greater lift or to provide plenums that can provide rigidity to the pallet.

In one embodiment of the present invention, the top surface of the air bearing pallet can be configured to provide a specific amount of load support. For example, the design of the walls of the air bearing pallet can be such that the top surface is shaped once the air bearing pallet is inflated. For example, the top surface can be configured to flex up at the outer edges to "cradle" the load, for example, a patient.

In addition, the plenum chambers can be nested so that one plenum chamber surrounds another plenum chamber.

The foregoing embodiments of the invention are exemplary and can be varied in many ways and, further, features of one embodiment may be combined with features of another embodiment and used in combination with features of more than one embodiment. Such present or future variations are not to be regarded as a departure from the spirit and scope of the invention, and all such modifications are intended to be included within the scope of the following claims.

The disclosure of all patents, publications, including published patent applications, and database entries referenced in this specification are specifically incorporated by reference in their entirety to the same extent as if each such individual patent, publication, and database entry were specifically and individually indicated to be incorporated by reference.

We claim:

1. A patient air bearing pallet adapted for connection to an air source, said air bearing pallet comprising:

an air bearing plenum chamber having an upper sheet and a bottom sheet;

a plurality of tethers connected between the upper sheet and the bottom sheet, and the tethers being arranged in a geometric pattern or a random arrangement and defining a plurality of spaced apart indentations at the bottom sheet upon inflation of the air bearing plenum chamber, wherein a lower end of each tether forms a cross-section shape in the bottom sheet enclosing only one of said indentations; and wherein the bottom sheet includes a plurality of perforations there through at least within the indentations, and the perforations being arranged into a plurality of groups of perforations, each group of perforations forming an air bearing, each air bearing being discrete and spaced from each of the other air bearings, and the air bearings forming an air film between the air bearing pallet and a support surface.

2. The air bearing pallet according to claim 1, wherein the tethers are arranged in a geometric array.

3. The air bearing pallet according to claim 1, wherein the array comprises a close packed array.

4. The air bearing pallet according to claim 1, wherein the tethers are generally orthogonally oriented between the upper sheet and the bottom sheet.

5. The air bearing pallet according to claim 1, wherein at least one of the tethers has an open cross-section shape.

6. The air bearing pallet according to claim 5, wherein said at least one of the tethers is formed from a loop or a strip of material.

7. The air bearing pallet according to claim 1, wherein at least one of the tethers has a non-geometric cross-section shape.

8. The air bearing pallet according to claim 1, wherein at least one of the tethers has a closed cross-section shape.

9. The air bearing pallet according to claim 8, wherein said at least one of the tethers has a closed geometric cross-section shape selected from the group consisting of a circle, an oval, and a multi-sided shape.

10. The air bearing pallet according to claim 1, wherein at least one of the tethers has a varying cross-section over its height.

11. The air bearing pallet according to claim 1, wherein each of the tethers has approximately the same height.

12. The air bearing pallet according to claim 1, wherein at least two of the tethers have different heights to thereby vary the height of the indentations associated with the at least two tethers.

13. The air bearing pallet according to claim 12, wherein a group of adjacent tethers of the tethers has a shorter height than the remaining tethers wherein the indentations of the group of adjacent tethers form a larger common indentation when the air pallet is unloaded.

14. The air bearing pallet according to claim 13, wherein said larger common indentation is located at a central portion of the bottom sheet wherein the larger common indentation forms a pre-curve in the air bearing pallet when the pallet is inflated and unloaded.

15. The air bearing pallet according to claim 1, wherein at least two of the tethers have different elasticity.

16. The air bearing pallet according to claim 1, wherein the upper sheet and bottom sheet are connected by one or more side panels.

17. The air bearing pallet according to claim 1, wherein at least a portion of the upper sheet is formed from a material with a different elasticity than the bottom sheet.

18. The air bearing pallet according to claim 1, wherein each of the indentations form creases in the bottom sheet, the creases of each indentation in the bottom sheet being separated and spaced from the creases of an adjacent indentation wherein the creases of each indentation are not in fluidic communication with the creases of any other indentation.

19. A patient air bearing pallet adapted for connection to an air source, said air bearing pallet comprising:

an air bearing plenum chamber having an upper sheet and a bottom sheet;

a plurality of tethers connected between the upper sheet and the bottom sheet, and the tethers being arranged in a geometric pattern or a random arrangement and defining a plurality of spaced apart indentations at the bottom sheet upon inflation of the air bearing plenum chamber wherein a lower end of each tether forms a cross-section shape in the bottom sheet enclosing only one of said indentations; and wherein the bottom sheet includes a plurality of perforations there through at least at the indentations, and the perforations providing for the creation of a plurality of air bearings, and the air bearings forming an air film between the air bearing pallet and a support surface, wherein the perforations are located inside the indentations, and the bottom sheet is generally free of perforations outside the indentations.

* * * * *